United States Patent [19]

Christ

[11] Patent Number: 4,847,005

[45] Date of Patent: Jul. 11, 1989

[54] SOLUTIONS OF HYDROLYTICALLY STABLE POLYMERIC ACETAL CARBOXYLATE SALTS AND STABLE LIQUID DETERGENT COMPOSITIONS CONTAINING SUCH SALTS

[75] Inventor: Thomas Christ, O'Fallon, Ill.

[73] Assignee: Monsanto Company, St. Louis, Mo.

[21] Appl. No.: 111,325

[22] Filed: Oct. 22, 1987

[51] Int. Cl.[4] ..... C11D 1/22; C11D 3/37

[52] U.S. Cl. ..... 252/545; 252/156; 252/173; 252/174.14; 252/174.16; 252/174.24; 252/DIG. 2; 252/DIG. 14; 252/558

[58] Field of Search ..... 252/174.24, DIG. 14, 252/95, 545, 558

[56] References Cited

U.S. PATENT DOCUMENTS

| | | | |
|---|---|---|---|
| T995,003 | 6/1980 | Zimmerman | 252/99 |
| 4,144,226 | 3/1979 | Crutchfield et al. | 528/231 |
| 4,146,495 | 3/1979 | Crutchfield et al. | 252/89 R |
| 4,204,052 | 5/1980 | Crutchfield et al. | 252/398 |
| 4,233,422 | 11/1980 | Dyroff | 525/398 |
| 4,315,092 | 9/1982 | Crutchfield et al. | 528/230 |
| 4,587,033 | 5/1986 | Dyroff et al. | 524/405 |
| 4,654,159 | 3/1987 | Bush et al. | 252/95 |
| 4,725,455 | 2/1988 | Taha | 427/221 |

FOREIGN PATENT DOCUMENTS 0117569 9/1984 European Pat. Off. .

*Primary Examiner*—Prince E. Willis

*Attorney, Agent, or Firm*—R. C. Loyer; A. H. Cole; A. E. Hoffman

[57] ABSTRACT

Hydrolytically stable liquid detergent formulations are disclosed containing the potassium salt of polymeric acetal carboxylates. Such liquid formulations remain single phase for extended periods of time.

18 Claims, No Drawings

SOLUTIONS OF HYDROLYTICALLY STABLE POLYMERIC ACETAL CARBOXYLATE SALTS AND STABLE LIQUID DETERGENT COMPOSITIONS CONTAINING SUCH SALTS

BACKGROUND OF THE INVENTION

This invention relates to liquid detergent compositions and more particularly to liquid laundry detergent compositions containing polymeric acetal carboxylate builders, and component solutions useful in the formulation thereof.

Materials known as "builders" are characterized by their capability for improving detergency levels of soaps and synthetic detergent compositions.

Builders exhibit a variety of performance properties which permit the attainment of better cleaning performance than is possible when so-called unbuilt compositions are used. The behavior mechanisms by which builders perform their function are only partially understood. It is known that good builders must be able to sequester most of the calcium and/or magnesium ions in the wash water since these ions are detrimental to the detergency process. However, it is difficult to predict which class of compounds possess useful combinations of builder properties and which compounds do not, because of the complex nature of detergency and the countless factors which contribute both to overall performance results and the requirements of environmental acceptability.

Conventionally, sodium tripolyphosphate (STP) has been a preferred and widely used detergent builder. However, because of the recent emphasis on removing phosphates from detergent and cleaning compositions for environmental reasons, the detergent and cleaning industry is now looking for materials suitable for use as builders which do not contain phosphorus and which are environmentally accepted.

Crutchfield et al U.S. Pat. No. 4,144,226 describes polymeric acetal carboxylates which are comprised of a series of repeating units corresponding to the formula

FORMULA I

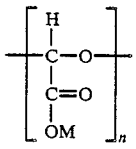

in which M is selected from among alkali metal, ammonium, alkyl groups having from 1–4 carbon atoms, tetraalkyl ammonium groups, and alkylamine groups having from 1 to about 4 carbon atoms in the alkyl chain; and n averages at least 4. To provide chemical stability, the polymer chain is provided with stabilizing end cap group so that the complete molecule corresponds to the formula

FORMULA II

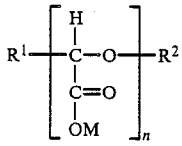

in which $R^1$ and $R^2$ are individually any chemically stable group which stabilizes the polymer against rapid depolymerization in the alkaline environment typical of wash solutions containing detergent. Particular groups which may comprise $R^1$ and $R^2$ include moieties derived from otherwise stable compounds such as alkanes, alkenes, branched chain hydrocarbons, both saturated and unsaturated, aromatic hydrocarbons, haloaklanes, alcohols, mercaptans, ethers, aldehydes, ketones, carboxylic acids, carboxylic acid salts, carboxylic acid esters, and carboxylic anhydrides.

As described, for example, in Crutchfield et al U.S. Pat. No. 4,140,676, the polymeric acetal carboxylates are prepared by polymerization of an ester of glyoxylic acid. For use as a builder, the resultant poly(glyoxylic acid ester) is preferably saponified to produce a salt. As described in Crutchfield et al U.S. Pat. No. 4,144,226 and a number of other patents, saponification is preferably carried out with sodium hydroxide to produce the sodium salt. Generally, the sodium salt represents the preferred species for use in formulating powder form detergents.

Polymeric acetal carboxylate builders are attractive because they are resonably resistant to degradation in alkaline solution and, thus, sufficiently stable to perform their function in the alkaline environment of washing or cleaning operations. However, these compositions are readily degradable in acidic solutions, and thus do not persist in the environment but instead are easily consumed in the course of conventional sewage treatment.

While detergents can be formulated in either solid or liquid form, solid powder has long been the commercially predominant form. Production, shipment and storage of the detergent in this form allows considerable latitude with regard to the solubility and hydrolytic stability of the builder. Recently, however, there has been a strong trend in the laundry detergent market for conversion from solid powder to liquid form products. Liquid detergents offer convenience to the user, but the formulation, shipment and storage of liquid detergents require a builder having substantial solubility and hydrolytic stability.

While the sodium salts of polymeric acetal carboxylates have more than sufficient solubility to function effectively in wash water, where the concentration of detergent may be in the range of 0.1 to 0.5% by weight, the sodium salts do not have the degree of solubility desirable for concentrated liquid detergent formulations. A high level of solubility is desired to permit the preparation of a concentrated liquid product, and also to minimize the amount of water brought into the formulation from the ingredient solution through which the builder is incorporated. In the formulating of liquid detergents, the various components are typically dissolved separately in water to produce a plurality of component solutions, and then these solutions are blended to produce the final product. The higher the feasible concentration of one component solution, the greater is the latitude provided with regard to other components; and the process of formulating thereby facilitated.

Although the sodium salt of an acetal carboxylate polymer has more than sufficient hydrolytic stability to serve its function in the washing-process, the sodium salt is subject to degradation over time when contained in aqueous solution, even one of optimal alkaline pH. A need has, therefore, existed for formulations which contain a form of polymeric acetal carboxylate salt which is both highly soluble and hydrolytically stable in aqueous liquid detergent compositions and the alkaline component solutions from which they are formulated.

Most of the prior work with polymeric acetal carboxylate builders has been directed toward powder form detergent formulations in which, as noted, the sodium salt is preferred. However, Crutchfield et al U.S. Pat. No. 4,144,226 makes passing reference to liquid dishwashing formulations, noting that they normally contain about 20 percent to about 45 percent surfactant, and that the weight ratio of surfactant to builder typically is in the range of 1:12 to 2:1. In another place, Crutchfield et al state that in some formulations, whether greater builder solubility is required, the use of ammonium or alkanolammonium salts may be desirable.

DelGreco et al U.S. Pat. No. 4,438,024 and Hughes U.S. Pat. No. 4,507,219 both contain disclosure of liquid detergent compositions which contain or may contain polyacetal carboxylate type builders. Hughes, in particular, discloses a relatively complex composition which is specified as containing a mix of potassium and sodium ions, in a potassium to sodium molar ratio of between about 0.1 and about 1.3. However, Hughes does not associate the $K^+$ or $Na^+$ ions with the builder; and neither Hughes nor DelGreco contains any teaching regarding the particularly form of polyacetal carboxylate salt to be used in the formulation. Moreover, each of these references discloses a plethora of different polycarboxylate builders, neither reference expresses any preference for polyacetal carboxylates, and neither contains any actual examples of formulations containing polyacetal carboxylates.

Aqueous liquid detergent compositions can be formulated in both homogeneous solution and emulsion form. In the case of a homogeneous solution, the surfactant and builder are present in colloidal micelles dispersed in the solvent, and may also be present to an extent in true solution. Generally, the homogeneous solution form is preferred because of its clarity and stability. However, relatively high concentrations of surfactant and builder can more readily be provided by resort to emulsion formulations. Especially high concentrations can be realized by preparation of the composition in the form of a gel or paste. For certain applications, these latter forms may be satisfactory. However, for most consumer laundry detergent applications, the homogeneous solution form is strongly preferred.

By use of cosolvents such as lower molecular weight alcohols or glycols, the solubility of sparingly soluble builders and other components can be increased. However, the use of alcohols or glycols adds to the expense of the detergent composition and may create additional problems or complications in the process of its formulation. Thus, there has been a particular need for forms of acetal carboxylate polymer salts which can be incorporated in substantial proportions in homogeneous aqueous solution, preferably without the need for cosolvents such as alcohols or glycols.

SUMMARY OF THE INVENTION

Among the several objects of the present invention, therefore, may be noted the provision of aqueous liquid detergent compositions in which an acetal carboxylate polymer salt is present in high concentration; the provision of such a detergent composition in which the acetal carboxylate is hydrolytically stable; the provision of such a detergent composition in which the polymeric acetal carboxylate salt is of sufficient molecular weight to function at high efficiency as a detergency builder; the provision of such a detergent composition containing a polymeric acetal carboxylate salt builder which can be synthesized at reasonable and competitive cost; the provision of such a detergent composition which consists of a homogeneous solution; the provision of such a detergent composition which consists of a stable single phase system; the provision of such a detergent composition which consists of single phase homogeneous solution system in which the solvent consists entirely of water; the provision of such a detergent composition which has properties rendering is effective as a laundry detergent.

Further objects of the invention include the provision of a stable water solution of a polyacetal carboxylate salt builder of sufficiently high concentration for use as a component solution in the formulation of concentrated liquid detergent compositions; the provision of such a solution in which the solvent consists essentially of water; and the provision of such a solution which can be used to produce a concentrated liquid detergent composition in homogeneous solution form.

Briefly, therefore, the present invention is directed to an aqueous composition that is useful in the formulation of liquid detergents. The composition comprises a solution containing at least about 5% by weight of the polymeric acetal carboxylate dissolved in a solvent consisting essentially of water. The polymeric acetal carboxylate comprises a series of repeating units corresponding to the formula:

FORMULA I

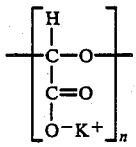

wherein n is at least about 9. Incidental amounts $Na^+$ cations may be present but is unnecessary and undesired.

The invention is further directed to a stable, aqueous liquid detergent composition containing at least about 5% by weight of an ionic or non-ionic surfactant and at least 5% by weight of a polymeric acetal carboxylate builder of the above described type.

The invention is further directed to a stable, single phase aqueous liquid detergent formulation comprising at least about 5% by weight of a trialkanolamine salt of a linear alkylbenzene sulfonic acid, at least about 5% by weight of a polymeric acetal carboxylate of the above described type, and a hydrotrope in a proportion sufficient that the formulation consists of single phase aqueous liquid at room temperature.

The invention is further directed to a method for formulating a stable, homogeneous, liquid detergent composition. In accordance with the method, an aqueous component solution containing at least about 5% by weight of an anionic or nonionic surfactant is mixed with an aqueous component solution containing at least about 5% by weight of a polyacetal carboxylate builder. The polyacetal carboxylate comprises a series of repeating units corresponding to the formula:

FORMULA I

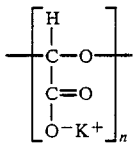

where n is as defined above. A predetermined proportion of water is added to the mixture of surfactant and builder component solutions, thereby producing a component mixture. A hydrotrope is added to the component mixture to produce a stable homogeneous liquid detergent composition.

Other objects and features will be in part apparent and in part pointed out hereinafter.

DESCRIPTION OF THE PREFERRED EMBODIMENTS

In accordance with the present invention, it has been discovered that the potassium salt of a polyacetal carboxylate polymer has a distinctively higher solubility in water than does the sodium salt. Moreover, the solubility of the potassium salt is preserved even when the polyacetal carboxylate is of relatively high molecular weight. This is important for two reasons, first because the higher molecular weight polyacetal carboxylates are more reliably effective as builders, and second because the cost of manufacture of the builder is generally an inverse function of its molecular weight.

Where the polymeric acetal carboxylate is of relatively low molecular weight, other salts, including the sodium salt, may provide a fairly high level of solubility. However, the lower molecular weight product has a high proportion of end cap moieties, and the manufacture of the low molecular weight material, therefore, consumes substantial amounts of the end cap precursor per unit weight of product. Because these end cap precursors are generally much more expensive raw materials than either the glyoxylic acid ester monomer or saponifying base, the cost of manufacture of the lower molecular weight polymers is correspondingly high. Thus, as a result of its high solubility even at high molecular weight, a functionally satisfactory potassium salt can be produced more economically than the sodium salt.

Moreover, it has been found that the potassium salt exhibits a high level of stability in aqueous solution. It has further been found that this stability is enhanced to especially high levels in detergent compositions which also contain an anionic or nonionic surfactant. Thus, it is possible to prepare liquid laundry detergents which contain a potassium salt of a polymeric acetal carboxylate in high concentration, and which exhibit extended shelf life sufficient for commercial distribution and consumer use of the high concentration liquid product.

As indicated, the polyacetal carboxylate salt builder contains a series of repeating units corresponding to the formula:

FORMULA I

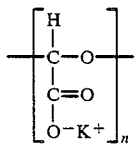

in which n is at least about 9. In order to assure maximal sequestering capability, n is preferably at least about 30, and to minimize the manufacturing cost of the builder while providing good builder effectiveness, n is most preferably between 50 and 100. The acetal carboxylate repeating units of the polymer may also contain unavoidable but insignificant amounts of other cations, mainly Na+. In addition to the acetal carboxylate units, the polymer may contain repeating units derived from other monomers such as aldehydes, epoxy compounds, olefins, etc.

As further noted above, the polymer includes end cap moieties which provide stability against degradation in alkaline media. Thus, the builder polymer molecule generally corresponds to the formula:

FORMULA II

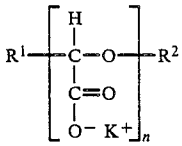

where $R^1$ and $R^2$ are end cap moieties and M and n are as defined above. By way of example, suitable chemically stable end groups include stable substituent moieties derived from otherwise stable compounds such as: alkanes such as methane, ethane, propane, butane, and higher alkanes such as decane, dodecane, cotadecane and the like; alkenes such as ethylene, propylene, butylene, decene, dodecene and the like, branch chain hydrocarbons, both saturated and unsaturated, such as 2-methyl butane, 2-methyl butene, 4-butyl-2,3-dimethyl octane and the like; aromatic hydrocarbons such as benzene, toluene, xylene, and the like; cycloalkanes, and cycloalkenes, such as cyclohexane and cyclohexene and the like; haloalkanes such as chloromethane, chlorobutane, dichloropentane and the like; alcohols such as methanol, ethanol, 2-propanol, cyclohexanol, sodium phenate, and the like; polyhydric alcohols such as 1,2-ethane diol, 1,4-benzene diol and the like; mercaptans such as methane thiol, 1,2-methanedithiol and the like, ethers such as the methoxyethane methyl ether, ethyl ether, ethoxy propane and cyclic ethers such as ethylene oxide, epichlorohydrin, tetramethylene oxide and the like; aldehydes and ketones and the like; and carboxylate-containing compounds such as the alkali metal salts of carboxylic acids, the esters of carboxylic acids and the anhydrides.

The above listing is exemplary and is not intended to be limiting since chemically stable end groups that stabilize the polymer against rapid depolymerization in an alkaline solution further include nitrilo groups and halides such as chlorides, bromides and the like. Further detail regarding suitable end groups can be found in Crutchfield et al U.S. Pat. No. 4,144,226. Of the various end-capping agents, alkyl vinyl ethers, especially methyl vinyl ether and ethyl vinyl ether, are most preferred.

A variety of water soluble anionic or nonionic surfactants can be employed in the detergent composition invention. Examples of suitable anionic surfactants include soaps such as salts of fatty acids containing about 9 to 20 carbon atoms such as, for example, salts of fatty acids derived from coconut oil and tallow; alkylbenzene sulfonates, particularly those in which the alkyl group contains 10 to 16 carbon atoms; alcohol sulphates;

ethyoxylated alcohol sulfates; hydroxy alkyl sulfonates; alkyl sulfates and sulfonates; monoglyceride sulfates; acid condensates of fatty acid chlorides with hydroxy alkyl sulfonates; and the like.

Preferably, the surfactant component of the detergent compositions of the invention comprises a linear alkylbenzene sulfonate. In contrast to the polymeric acetal carboxylate builder, the more soluble species of the linear alkylbenzene sulfonate surfactant is the sodium salt rather than potassium salt. Generally, therefore, the sodium salt is satisfactory in the case of the surfactant. There is apparently no significant ion exchange between the surfactant and the builder, since potassium salt builders maintain a high level of solubility over extended storage periods, regardless of the nature of the counteraction of the anionic surfactant. However, as discussed in further detail hereinbelow, for maximum initial solubility and establishment of a single phase homogeneous solution of high concentration, the alkanolamine salt of the surfactant is preferred.

Additionally or alternatively, the detergent composition of the invention may contain a nonionic surfactant. Examples of suitable nonionic surfactants include alkylene oxide (e.g., ethylene oxide condensates of mono and polyhydroxy alcohols, alkyl phenols, fatty acid amides, and fatty amines; amine oxides; sugar derivatives such as sucrose monopalmitate; long chain tertiary phosphine oxides; dialkyl sulfoxides; fatty acid amides, (e.g., mono or diethanol amides of fatty acids containing 10 to 18 carbon atoms); and the like.

The aqueous detergent composition suitable for dilution in actual use should contain at least about 5% by weight, preferably at least about 10% by weight, of the ionic or nonionic surfactant, and at least about 5% by weight, preferably at least about 10% by weight of the polymeric acetal carboxylate salt builder. For consumer liquid laundry detergents, the concentration of surfactant should typically fall in the range of about 10% to about 40% by weight and the builder concentration should be between about 10% and about 30% by weight, the balance of the composition being predominantly water. Preferably, the detergent composition is in the form of a homogeneous solution, i.e., having the builder and surfactant present in the true solution or as colloidal micelles. However, detergent compositions of the invention containing between about 25% and about 75% by weight water can also be produced in emulsion form or even as a paste or gel.

It is preferred that the pH of the liquid detergent composition be in the range of between about 9 and about 10.5. In order to provide positive control of pH, it is advantageous to incorporate water soluble buffers known in art. Typical examples include alkanolamines and alkali metal hydroxides, etc. An alkaline component such as an alkali metal carbonate salt may be employed in paste or gel detergent compositions. Preferably, the alkaline component is triethanol amine and is present in a proportion of between about 1% and about 5% by weight.

Further in accordance with the instant invention, it has been found possible to produce a relatively concentrated detergent composition which consists of a single phase homogeneous aqueous solution. More particularly, it has been discovered that, by use of an alkanolamine salt of a linear alkylbenzene sulfonate in combination with a polymeric acetal carboxylate potassium salt and a hydrotrope, highly stable single phase homogeneous aqueous solution systems can be produced. Moreover, it has been found that such combination can be maintained as a stable single phase system even where the number of acetal carboxylate repeating units of the builder is in excess of 30. In fact, a homogeneous single phase solution system is maintained even where the number of repeating units in the builder is in the range of 50 to 100.

Preferably, the hydrotrope component of the single phase detergent system comprises a phosphate ester such as Triton H-55 sold commercially by Rohm and Haas Company. Alternatively, other hydrotropes may be used, most particularly the aryl sulfonic acid salts such as benzene sulfonates, toluene sulfonates and xylene sulfonates. The single phase homogeneous liquid solution compositions of the invention should contain at least about 5% by weight linear alkylbenzene surfactant, at least about 5% by weight of the builder potassium salt, and a proportion of hydrotrope sufficient to maintain a single phase homogeneous solution. Generally, the single phase aqueous liquid detergent compositions contain at least about 5% by weight of the hydrotrope. Preferably, they contain between about 10% and about 40% by weight surfactant, between about 10% and 30% by weight builder, and between about 5% and about 20% by weight hydrotrope. Relatively high concentration of surfactant and builder, for example, at levels of at least about 25% of each, impart potent cleaning properties which make the liquid composition affective for direct application to fabric and removal of deeply embedded soil therefrom.

In accordance with the method of the invention, an aqueous component solution containing surfactant only is prepared; and an aqueous solution of the polymeric acetal carboxylate potassium salt builder is prepared and admixed to the surfactant solution, conveniently by adding the former solution to a vessel containing the latter. Preferably, these respective component solutions are concentrates which may each typically contain 30–60% of the active component. In the case of the builder, this minimizes the cost of handling, storing and shipping since it minimizes the weight and volume of water that must be included in the component solution before it is used. After the concentrated builder component solution has been added to the surfactant solution, the resulting mixture is diluted with predetermined amount of water calculated to provide the proper concentrations of active ingredients in the finished product. Thereafter, the hydrotrope is added to the diluted component mixture. The hydrotrope component may be added neat or in another component solution, advantageously an aqueous concentrate. In the latter instance, the amount of water added to the surfactant/builder mixture before addition of the hydrotrope is adjusted to compensate for the amount of water to be added with the hydrotrope. But in any case, the high solubility of the acetal carboxylate potassium salt facilitates the management and control of the formulating process.

The mixing process is conveniently carried out at room temperature using a normal level of agitation sufficient for mixing. Because of the high level of solubility exhibited by the potassium salt form of the polymeric acetal carboxylate builder, neither elevated temperatures nor high shear mixing is needed to achieve a stable homogeneous liquid detergent product.

Where the strength of the builder component solution is in the range of 40–60% by weight polyacetal carboxylate builder, the solution may also be used in formulating powder form detergent compositions. A principal object of the present invention is to produce stable liquid detergent formulations of high concentration, but the enhanced solubility and hydrolytic stability of the potassium salt form builder provides advantages in the formulation of powder detergent compositions as well. Thus, the builder component solution of the invention can be shipped and stored without degradation, and the cost of shipping as well as the energy costs of spray drying are minimized by the high strength of the component solution.

The following examples illustrate the invention wherein percentage figures are present by weight of solids dissolved in aqueous solution. In examples below the polyacetal carboxylate, potassium salt, is a polymer have repeating units in the range of from 30 - 100 and end capped with methylvinylether unless noted otherwise.

EXAMPLE 1

The following liquid detergent composition was prepared and found to remain in a single phase upon storage under ambient room temperature for a period of at least 30 days.

| Component | % |
|---|---|
| $C_{12}$ alkylbenzene sulfonate | 15 |
| sodium xylene sulfonate | 8 |
| polyacetal carboxylate, potassium salt | 15 |
| water | 62 |

EXAMPLE 2

The following liquid detergent composition was prepared to illustrate the incorporation of a hydrotrope in the formulation. The composition remained a clear, single phase solution for a period of over 60 days.

| COMPONENT | % |
|---|---|
| $C_{12}$ alkylbenzene sulfonate | 15 |
| [1]alkylphosphate ester | 10 |
| polyacetal carboxylate, potassium salt | 10 |
| water | 65 |

[1]A product marked commercially by Rohm & Haas Company under the trade name Triton H-55.

EXAMPLE 3

The following liquid detergent formulation was prepared as a clear solution which remained a single phase for over 90 days. This formulation illustrates the incorporation of a pH control agent and a mixed surfactant.

| COMPONENT | % |
|---|---|
| $C_{12}$ alkylbenzene sulfonate | 10 |
| sodium alcohol ethoxy sulfate[1] | 8.6 |
| triethanol amine | 5 |
| polyacetal carboxylate, potassium salt | 10 |
| ethanol | 5 |
| water | 66.4 |

[1]a product marketed commercially by Shell Oil Company under the trade name Neodol 25-35.

EXAMPLE 4

The following liquid detergent formulation illustrates a mixed surfactant detergent product which remained a clear, single phase solution for over 60 days.

| COMPONENT | % |
|---|---|
| sodium alcohol ethoxy sulfate[1] | 5.8 |
| alcohol ethoxylate[2] | 10.7 |
| monothanolamine | 1 |
| polyacetal carboxylate, potassium salt | 10 |
| ethanol | 4 |
| water | 68.5 |

[1]a product marketed commercially by Shell Oil Company under the trade name Neodol 25-35.
[2]a product marketed commercially by Shell Oil Company under the trade name Neodol 23 + 6.5.

EXAMPLE 5

The following liquid detergent formulation was prepared which remained a clear, single phase solution for over 30 days.

| COMPONENT | % |
|---|---|
| $C_{12}$ alkylbenzene sulfonate | 15 |
| sodium xylene sulfonate | 8 |
| sodium carbonate | 5 |
| polyacetal carboxylate, potassium salt | 10 |
| water | 62 |

EXAMPLE 6

The following liquid detergent formulation was prepared with a polyacetal carboxylate potassium salt having repeating units in the range of from 30 to 50 and end capped with the ethylvinylether. This formulation remained a single phase solution for over 30 days.

| COMPONENT | % |
|---|---|
| $C_{12}$ alkylbenzene sulfonate | 10 |
| sodium xylene sulfonate | 8 |
| potassium carbonate | 8 |
| polyacetal carboxylate, potassium salt | 15 |
| water | 59 |

There has been described novel compositions which, under ambient room conditions, exhibited stable solutions unlike other polyacetalcarboxylate detergent compositions previously known. While the invention has been described with reference to particular substances it is understood that other alternate components may be employed with the potassium salt of polyacetal carboxylate without departing from this invention.

What is claimed is:

1. A stable liquid detergent composition consisting of a single phase homogeneous aqueous solution containing:

at least about 5% to about 40% by weight of anionic or nonionic surfactant;

at least about 5% ty about 30% by weight of a polymeric acetal carboxylate builder, said polymeric acetal carboxylate builder comprising a series of repeating units corresponding to the formula

FORMULA I

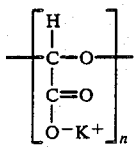

where n is at least about 9 to about 100; and from about 5% to about 20% by weight of a hydrotrope in a proportion sufficient that the composition consists of a single phase homogeneous solution.

2. A liquid detergent composition as set forth in claim 1 wherein said hydrotrope comprises a phosphate ester.

3. A stable aqueous detergent composition as set forth in claim 1 wherein n is at least about 30.

4. A stable aqueous detergent composition as set forth in claim 1 further comprising an alkanolamine.

5. A stable aqueous detergent composition as set forth in claim 4 having a pH of between about 9 and about 10.5

6. A stable liquid detergent composition consisting of a single phase homogeneous aqueous solution containing:

at least about 5% to about 40% by weight of anionic or nonionic surfactant;

from about 1% to about 5% by weight of a buffer;

at least about 5% to about 30% by weight of a polymeric acetal carboxylate builder, said polymeric acetal carboxylate builder comprising a series of repeating units corresponding to the formula

FORMULA I

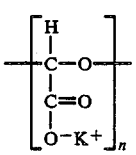

where n is at least about 9 to about 100; and from about 5% to about 20% by weight of a hydrotrope in a proportion sufficient that the composition consists of a single phase homogeneous solution.

7. A liquid detergent composition as set forth in claim 6 wherein said hydrotrope comprises a phosphate ester and the buffer is potassium carbonate.

8. A composition of claim 6 wherein the buffer is selected from the group consisting of alkanolamine alkali metal hydroxide and alkali metal carbonate.

9. A stable aqueous detergent composition as set forth in claim 6 wherein n is at least about 30.

10. A stable aqueous detergent composition as set forth in claim 8 wherein the buffer is an alkanolamine.

11. A stable aqueous detergent composition as set forth in claim 10 having a pH of between about 9 and about 10.5

12. A stable liquid detergent composition consisting of a single phase homogeneous aqueous solution containing:

at least about 5% to about 40% by weight of an alkanolamine salt of a linear alkyl benzene sulfonate surfactant;

at least about 5% to about 30% by weight of a polymeric acetal carboxylate builder, said polymeric acetal carboxylate builder comprising a series of repeating units corresponding to the formula

FORMULA I

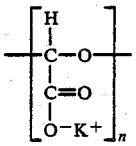

wherein n is at least about 9 to about 100; and from about 5% to about 20% by weight of a hydrotrope in a proportion sufficient that the composition consists of a single phase homogeneous solution.

13. A liquid detergent composition as set forth in claim 12 wherein said hydrotrope comprises a phosphate ester.

14. A stable aqueous detergent composition as set forth in claim 12 wherein n is at least about 30.

15. A stable aqueous detergent composition as set forth in claim 18 further comprising an alkanolamine.

16. A stable aqueous detergent composition as set forth in claim 15 having a pH of between about 9 and about 10.5

17. A method for formulating a stable homogeneous liquid detergent composition comprising the steps of:

mixing an aqueous component solution containing at least about 5% by weight of anionic of nonionic surfactant with an aqueous component solution containing at least about 5% by weight of a polymeric acetal carboxylate builder, said polymeric units corresponding to the formula:

FORMULA I

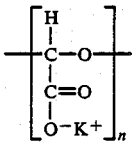

where n is at least 9 to about 100;

adding a predetermined proportion of water to the mixture of surfactant and builder component solutions, thereby producing a diluted component mixture; and adding a hydrotrope to the said diluted component mixture, thereby producing a stable homogeneous liquid composition.

18. A process as set forth in claim 17 wherein said builder component solution is added to a vessel containing said surfactant component solution.

* * * * *